US010859083B2

(12) United States Patent
Takamura et al.

(10) Patent No.: US 10,859,083 B2
(45) Date of Patent: Dec. 8, 2020

(54) SCROLL COMPRESSOR

(71) Applicant: Mitsubishi Electric Corporation, Tokyo (JP)

(72) Inventors: Yuji Takamura, Tokyo (JP); Tomokazu Matsui, Tokyo (JP); Masayuki Kakuda, Tokyo (JP); Hideaki Nagata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 171 days.

(21) Appl. No.: 16/085,820

(22) PCT Filed: Mar. 28, 2017

(86) PCT No.: PCT/JP2017/012546
§ 371 (c)(1),
(2) Date: Sep. 17, 2018

(87) PCT Pub. No.: WO2017/199588
PCT Pub. Date: Nov. 23, 2017

(65) Prior Publication Data

US 2019/0063436 A1 Feb. 28, 2019

(30) Foreign Application Priority Data

May 20, 2016 (WO) ..... PCT/JP2016/065042

(51) Int. Cl.
*F04C 29/00* (2006.01)
*F04C 18/02* (2006.01)

(52) U.S. Cl.
CPC ..... *F04C 29/0021* (2013.01); *F04C 18/0215* (2013.01); *F04C 29/0057* (2013.01);
(Continued)

(58) Field of Classification Search
CPC ..... F04C 18/0215; F04C 2240/50; F04C 2240/807; F04C 29/0021; F04C 29/0057; F05B 2240/54
See application file for complete search history.

(56) References Cited

U.S. PATENT DOCUMENTS

2015/0078945 A1 3/2015 Su et al.
2017/0089341 A1 3/2017 Takamura

FOREIGN PATENT DOCUMENTS

JP H10-281083 A 10/1998
JP H11-022661 A 1/1999
(Continued)

OTHER PUBLICATIONS

Office Action dated Jul. 16, 2019 issued in corresponding JP patent application No. 2018-518136 (and English translation).
(Continued)

*Primary Examiner* — Mary Davis
(74) *Attorney, Agent, or Firm* — Posz Law Group, PLC

(57) ABSTRACT

A scroll compressor includes a slider including a cylindrical portion supported by a rocking bearing provided on an orbiting scroll so that it rotates freely, and a balance weight portion connected to the cylindrical portion. When a direction opposite to an eccentric direction of the orbiting scroll is a counter eccentric direction and a direction of a central axis of the rocking bearing is a Z-axis direction, the balance weight portion includes a main weight portion provided at a position distant from a center of rotation of the slider in the counter eccentric direction, and a counter-weight portion provided at a position spaced away from the orbiting scroll than a position of a center of the rocking bearing in the Z-axis direction and at a position distant from the center of rotation of the slider in the eccentric direction.

9 Claims, 9 Drawing Sheets

(52) U.S. Cl.
CPC .... *F04C 2240/50* (2013.01); *F04C 2240/807* (2013.01); *F05B 2240/54* (2013.01)

(56) References Cited

FOREIGN PATENT DOCUMENTS

| | | | |
|---|---|---|---|
| JP | 2014-101753 | A | 6/2014 |
| WO | 2015/194000 | A1 | 12/2015 |

OTHER PUBLICATIONS

International Search Report of the International Searching Authority dated Jun. 20, 2017 for the corresponding international application No. PCT/JP2017/012546 (and English translation).

C–C

SCROLL COMPRESSOR

CROSS REFERENCE TO RELATED APPLICATION

This application is a U.S. national stage application of International Application No. PCT/JP2017/012546, filed on Mar. 28, 2017, which claims priority to International Application No. PCT/JP2016/065042, filed on May 20, 2016, the contents of which are incorporated herein by reference.

TECHNICAL FIELD

The present invention relates to a scroll compressor configured to compress working gas.

BACKGROUND

Hitherto, there is proposed a scroll compressor in which at least a part of a centrifugal force generated on an orbiting scroll is canceled by a slider with a balance weight and the radius of revolution of the orbiting scroll is made variable through sliding of the slider. Specifically, the slider has a cylindrical portion whose outer peripheral surface is supported by a rocking bearing provided on the orbiting scroll so that the cylindrical portion rotates freely and into which an eccentric shaft portion is inserted. Further, the slider has a balance weight portion that is disposed in a counter eccentric direction that is a direction opposite to an eccentric direction of the eccentric shaft portion and is connected to the cylindrical portion. When the rocking bearing is rocked by rotating a spindle provided with the eccentric shaft portion at one end thereof, the slider rotates together with the spindle and the eccentric shaft portion. Further, at least a part of the centrifugal force generated on the orbiting scroll is canceled by a centrifugal force generated on the balance weight portion when the slider rotates.

In this case, when the slider rotates in a state in which the cylindrical portion of the slider and the rocking bearing are kept parallel to each other, a center of action of an oil film reactive force generated between the rocking bearing and the outer peripheral surface of the cylindrical portion of the slider is a center of the rocking bearing in a central axis direction. On the other hand, it is necessary to connect the cylindrical portion and the balance weight portion of the slider in an area where the rocking bearing is not present. In other words, the connection part where the cylindrical portion and the balance weight portion are connected is located in an area where the rocking bearing is not present. For example, in a case of a vertical scroll compressor, the connection part where the cylindrical portion and the balance weight portion of the slider are connected is located below the rocking bearing. To bear the centrifugal force generated on the balance weight portion, the connection part needs to be thick to some extent in terms of strength. Therefore, when the slider rotates, a center of action of the centrifugal force generated on the slider may deviate from the center of the rocking bearing in the central axis direction and the slider is tilted. When the slider is tilted, the slider slides while the moments of force generated on the slider are balanced with each other in a state in which the center of action of the oil film reactive force coincides with the center of action of the centrifugal force generated on the slider and the slider is inclined relative to the rocking bearing. When the slider slides while being inclined relative to the rocking bearing, however, the minimum oil film thickness on the rocking bearing decreases compared with the case in which the slider rotates in the state in which the cylindrical portion of the slider and the rocking bearing are kept parallel to each other. Thus, in the related-art scroll compressor, due to the decrease in the minimum oil film thickness on the rocking bearing, there is a risk of the occurrence of a so-called biased contact, in which the cylindrical portion of the slider is brought into contact with the rocking bearing without intermediation of the oil film.

In view of the above, as the related-art scroll compressor including the slider with a balance weight, there is proposed a scroll compressor in which the center of action of the centrifugal force generated on the slider and the center of the rocking bearing in the central axis direction are made to substantially coincide with each other, thereby preventing the biased contact caused by the tilt of the slider (see Patent Literature 1). Specifically, in the scroll compressor described in Patent Literature 1, which is a vertical scroll compressor, the center of action of the centrifugal force generated on the slider and the center of the rocking bearing in the central axis direction are made to substantially coincide with each other by increasing the height of the upper end of the balance weight portion compared with that of the cylindrical portion to raise the center of action of the centrifugal force generated on the slider. Further, in the scroll compressor described in Patent Literature 1, which is a vertical scroll compressor, the center of action of the centrifugal force generated on the slider and the center of the rocking bearing in the central axis direction are made to substantially coincide with each other by sufficiently increasing the radius of the upper part of the balance weight portion compared with the radius of the lower part thereof to raise the center of action of the centrifugal force generated on the slider.

Patent Literature

Patent Literature 1: Japanese Unexamined Patent Application Publication No. 10-281083

However, the scroll compressor described in Patent Literature 1 has the following problems due to an increase in size of the slider.

For example, when the upper end of the balance weight portion is positioned higher than that of the cylindrical portion, a stress applied to a root of the balance weight portion increases, thereby causing a problem that the reliability may decrease. Further, it is necessary that the length of a boss of the rocking scroll where the rocking bearing is provided be increased along with the increase in the overall height of the balance weight portion. Therefore, when the upper end of the balance weight portion is positioned higher than that of the cylindrical portion, the amount of deformation of the boss of the orbiting scroll increases, thereby causing a problem that the performance of the scroll compressor may decrease. Further, the scroll compressor includes a frame provided with bearings that support the spindle so that the spindle rotates freely. Further, the slider is received in a recess formed in the frame. Therefore, when the upper end of the balance weight portion is positioned higher than that of the cylindrical portion, it is necessary to increase the length of the frame as well. Thus, when the upper end of the balance weight portion is positioned higher than that of the cylindrical portion, material costs increase due to the increase in the lengths of the boss of the orbiting scroll and the frame, thereby causing a problem that the cost of the scroll compressor may increase.

Further, for example, when the radius of the upper part of the balance weight portion is sufficiently large as compared with the radius of the lower part thereof, the centrifugal force generated on the balance weight portion increases excessively. Therefore, it is difficult to achieve both designing for setting an arbitrary degree of the centrifugal force and prevention of the tilt of the slider, thereby causing a problem that the reliability or performance of the scroll compressor may be deteriorated. Further, the size of the frame in which the slider is received increases along with the increase in the radius of the upper part of the balance weight portion. As a result, the material costs increase, thereby causing a problem that the cost of the scroll compressor may increase.

SUMMARY

The present invention has been made to solve the problems described above and it is therefore an object thereof to provide a scroll compressor in which a biased contact of a cylindrical portion of a slider with a rocking bearing can be prevented while suppressing an increase in the size of the slider.

A scroll compressor according to an embodiment of the present invention includes a fixed scroll, an orbiting scroll configured to orbit relative to the fixed scroll, a spindle configured to transfer a rotational driving force to the orbiting scroll, an eccentric shaft portion provided at one end of the spindle and offset in an eccentric direction from a central axis of the spindle, a slider having a slide groove formed therein so that the eccentric shaft portion is inserted into the slide groove to slide freely, and a rocking bearing provided on the orbiting scroll to support the slider so that the slider rotates freely. The slider includes a cylindrical portion supported by the rocking bearing to rotate freely, and a balance weight portion connected to the cylindrical portion. When a direction opposite to the eccentric direction is a counter eccentric direction and a direction of the central axis is a Z-axis direction, the balance weight portion includes a main weight portion provided at a position distant from a center of rotation of the slider in the counter eccentric direction, and a counter-weight portion provided at a position spaced away from the orbiting scroll than a center of the rocking bearing in the Z-axis direction and at a position distant from the center of rotation of the slider in the eccentric direction. A distance in the Z-axis direction between a center of action of a centrifugal force on the slider and the center of the rocking bearing is equal to or smaller than 0.09 times a length of the rocking bearing in the Z-axis direction.

In the scroll compressor according to the embodiment of the present invention, when the slider rotates, a centrifugal force in the eccentric direction is generated on the counter-weight portion at a position spaced away from the orbiting scroll than the position of the center of the rocking bearing in the Z-axis direction. With this centrifugal force, a centrifugal force generated at a position spaced away from the orbiting scroll in a centrifugal force generated on the main weight portion can be canceled mainly. Therefore, in the scroll compressor according to the embodiment of the present invention, the center of action of the centrifugal force generated on the slider and the center of the rocking bearing in the Z-axis direction can be made to substantially coincide with each other while suppressing the increase in the size of the slider. Thus, in the scroll compressor according to the embodiment of the present invention, the biased contact of the cylindrical portion of the slider with the rocking bearing can be prevented while suppressing the increase in the size of the slider. Further, when the distance in the Z-axis direction between the center of action of the centrifugal force on the slider and the center of the rocking bearing is set equal to or smaller than 0.09 times the length of the rocking bearing in the Z-axis direction, the reliability of the scroll compressor can be secured even under a high-oil temperature condition, in which the oil film thickness is difficult to be secured on the rocking bearing.

DETAILED DESCRIPTION

Embodiment 1

Figure 1:
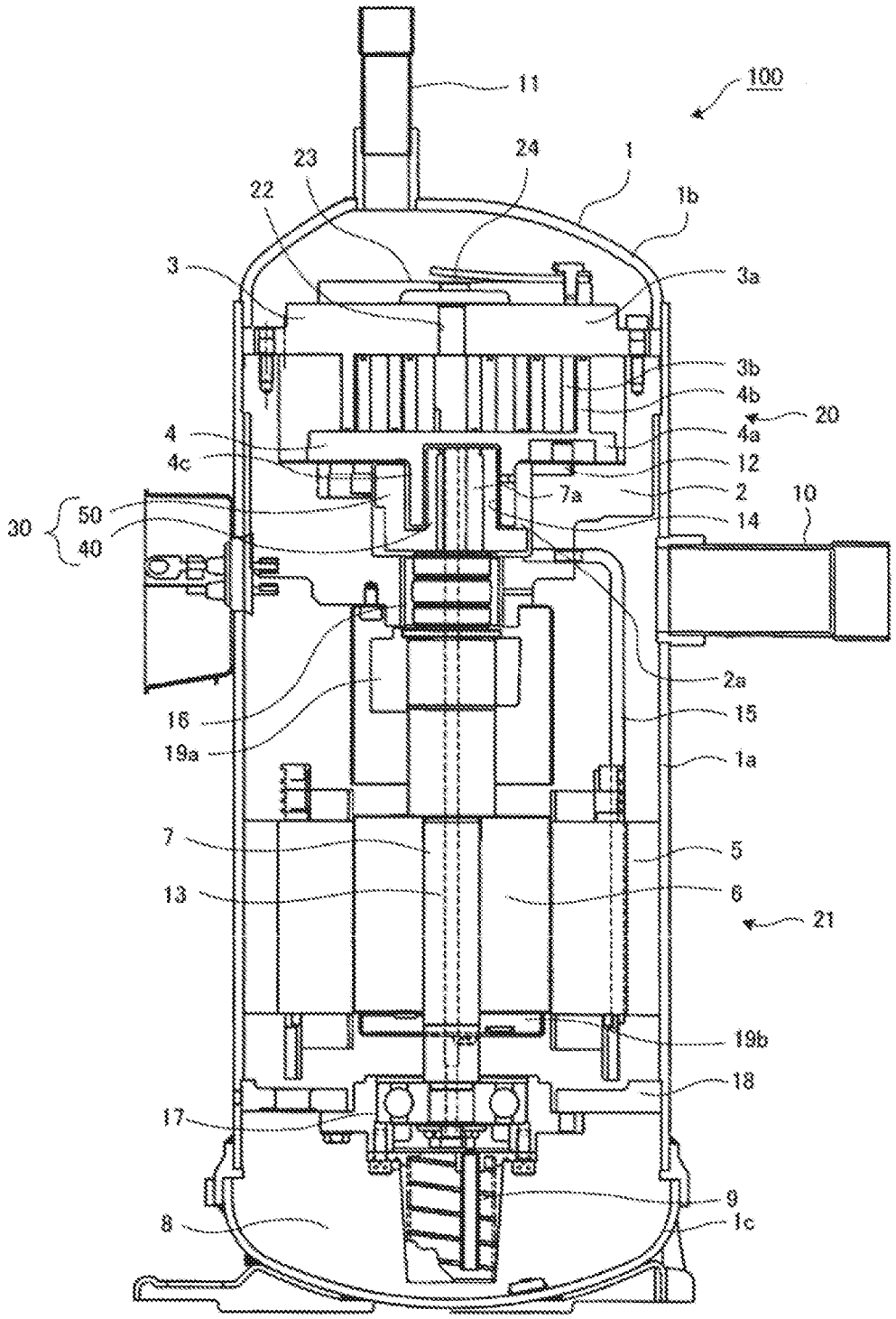
FIG. 1 is a schematic vertical sectional view of a scroll compressor according to Embodiment 1 of the present invention.

FIG. 1 is a schematic vertical sectional view of a scroll compressor according to Embodiment 1 of the present invention. Note that, in FIG. 1, the hatching of the cross section is omitted for allowing the leader lines to be viewed clearly.

A scroll compressor 100 is a component of a refrigeration cycle apparatus for use in, for example, a refrigerator, a freezer, a vending machine, an air-conditioning apparatus, a freezing machine, or a water heater. In Embodiment 1, a vertical scroll compressor, in which a spindle 7 is disposed in a vertical direction, is exemplified as the scroll compressor 100. Note that, in the figures including FIG. 1 referenced below, for example, the relationship of dimensions of components and the shapes thereof may differ from an actual relationship and actual shapes. Further, in the following description, the positional relationship between the components (for example, a relationship in which one component is located above or below the other) is basically a positional relationship in a case where the scroll compressor is installed in a state that is ready to use.

The scroll compressor 100 sucks refrigerant (example of working gas) that circulates through a refrigerant circuit of the refrigeration cycle apparatus, compresses the refrigerant, and discharges the refrigerant in a high-temperature and high-pressure state. As illustrated in FIG. 1, the scroll compressor 100 includes a compression mechanism unit 20 configured to compress the refrigerant, a motor unit 21 configured to drive the compression mechanism unit 20, and a sealed container 1 that contains the compression mechanism unit 20 and the motor unit 21. The compression mechanism unit 20 is disposed in an upper part of the sealed container 1. The motor unit 21 is disposed below the compression mechanism unit 20 in the sealed container 1.

The sealed container 1 has a cylindrical body 1*a*, a lid 1*b* disposed at the upper end of the body 1*a*, and a bottom 1*c* disposed at the lower end of the body 1*a*. The body 1*a* and the lid 1*b* are joined together and the body 1*a* and the bottom 1*c* are joined together by welding or other methods to secure air tightness.

The compression mechanism unit 20 includes a fixed scroll 3 fixed to a frame 2 attached to the sealed container 1, and an orbiting scroll 4 configured to orbit (that is, revolve) relative to the fixed scroll 3. The fixed scroll 3 has a base plate 3*a* and a spiral scroll lap 3*b* provided on one surface (lower surface in FIG. 1) of the base plate 3*a*. The orbiting scroll 4 has a base plate 4*a* and a spiral scroll lap 4*b* provided on one surface (upper surface in FIG. 1) of the base plate 4*a*. The fixed scroll 3 and the orbiting scroll 4 are assembled so that the scroll laps 3*b* and 4*b* engage with each other. A compression chamber in which the refrigerant is compressed is formed between the scroll lap 3*b* and the scroll lap 4*b*.

At a central part of the base plate 3*a* of the fixed scroll 3, a discharge port 22 through which the compressed refrigerant is discharged from the compression chamber is formed through the base plate 3*a*. A discharge chamber 23 is provided near the outlet of the discharge port 22. A discharge valve 24 having a reed valve structure is provided at the outlet of the discharge chamber 23.

A cylindrical boss 4*c* is formed at a central part of a surface (lower surface in FIG. 1) of the base plate 4*a* of the orbiting scroll 4 opposite the surface where the scroll lap 4*b* is formed. A rocking bearing 14 (journal bearing) that supports a cylindrical portion 40 of a slider 30 described later so that the cylindrical portion 40 rotates freely is provided on the inner periphery of the boss 4*c*. The central axis of the rocking bearing 14 is parallel to the central axis of the spindle 7.

An Oldham ring 12 is provided between the orbiting scroll 4 and the frame 2. The Oldham ring 12 has a ring, a pair of Oldham keys formed on the upper surface of the ring, and a pair of Oldham keys formed on the lower surface of the ring. The Oldham keys on the upper surface are inserted into keyways formed in the orbiting scroll 4 and freely slide in one direction. The Oldham keys on the lower surface are inserted into keyways formed in the frame 2 and freely slide in a direction intersecting the above-mentioned one direction. With this structure, the orbiting scroll 4 revolves instead of rotating about its axis.

The motor unit 21 includes a stator 5 fixed to the inner periphery of the sealed container 1, a rotor 6 disposed inside of the stator 5, and the spindle 7 fixed to the rotor 6. When the stator 5 is energized, the rotor 6 rotates together with the spindle 7. An upper part of the spindle 7 is supported by a main bearing portion 16 provided on the frame 2 so that the spindle 7 rotates freely. A lower part of the spindle 7 is supported by an auxiliary bearing portion 17 (for example, a ball bearing) so that the spindle 7 rotates freely. The auxiliary bearing portion 17 is provided on a subframe 18.

An eccentric shaft portion 7*a* is provided at the upper end of the spindle 7. The eccentric shaft portion 7*a* is disposed while being offset from the central axis of the spindle 7 in a predetermined eccentric direction. The eccentric shaft portion 7*a* is inserted into a slide groove 43 of the slider 30 described later to slide freely.

An oil reservoir 8 in which lubricating oil is stored is provided at the bottom of the sealed container 1. An oil pump 9 configured to pump up the lubricating oil in the oil reservoir 8 is provided at the lower end of the spindle 7. Inside the spindle 7, an oil hole 13 is formed along the central axis of the spindle 7. The lubricating oil pumped up from the oil reservoir 8 by the oil pump 9 flows through the oil hole 13 and is supplied to sliding portions including the rocking bearing 14. Further, an oil drain pipe 15 through which the lubricating oil in the frame 2 returns to the oil reservoir 8 is connected to the frame 2.

A first balancer 19*a* configured to cancel an imbalance caused by the orbiting of the orbiting scroll 4 is provided at an upper part of the spindle 7. A second balancer 19*b* configured to cancel the imbalance caused by the orbiting of the orbiting scroll 4 is provided at a lower part of the rotor 6.

Further, the sealed container 1 is provided with a suction pipe 10 through which low-pressure gas refrigerant is sucked from the outside, and a discharge pipe 11 through which the compressed high-pressure gas refrigerant is discharged to the outside.

Now, an overall operation of the scroll compressor 100 is briefly described. The rotor 6 rotates when the stator 5 is energized. A rotational driving force of the rotor 6 is transferred to the orbiting scroll 4 via the spindle 7, the eccentric shaft portion 7*a*, and the slider 30. The orbiting scroll 4 to which the rotational driving force is transferred orbits relative to the fixed scroll 3 while being prevented by the Oldham ring 12 from rotating about the axis of the orbiting scroll 4.

Along with the orbiting of the orbiting scroll 4, the low-pressure gas refrigerant sucked into the sealed container 1 through the suction pipe 10 is taken into the compression chamber through an unillustrated suction port formed in the frame 2 and is compressed in the compression chamber. The compressed high-pressure gas refrigerant is discharged into the discharge chamber 23 via the discharge port 22. The high-pressure gas refrigerant in the discharge chamber 23 pushes up the discharge valve 24 and is discharged to a high-pressure space between the fixed scroll 3 and the sealed container 1. Then, the high-pressure gas refrigerant is discharged to the outside of the scroll compressor through the discharge pipe 11.

Figure 2:
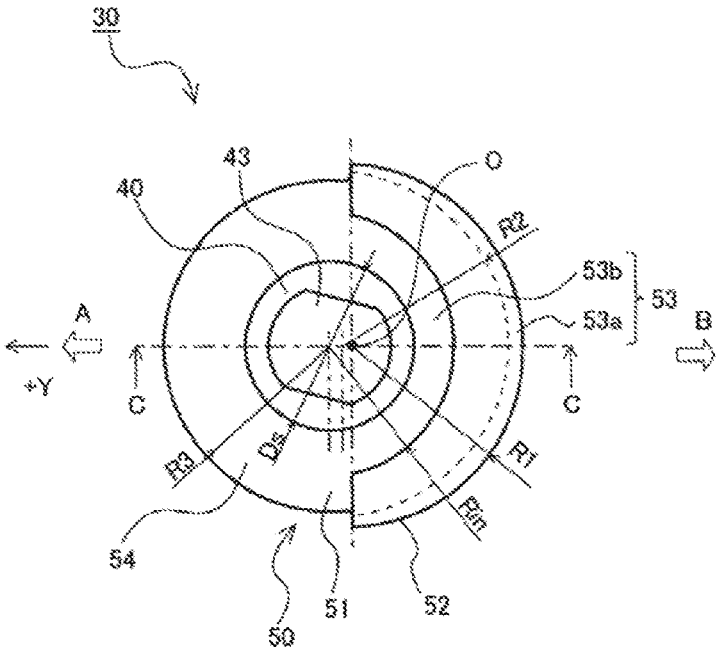
FIG. 2 is a plan view illustrating a slider of the scroll compressor according to Embodiment 1 of the present invention.
Figure 3:
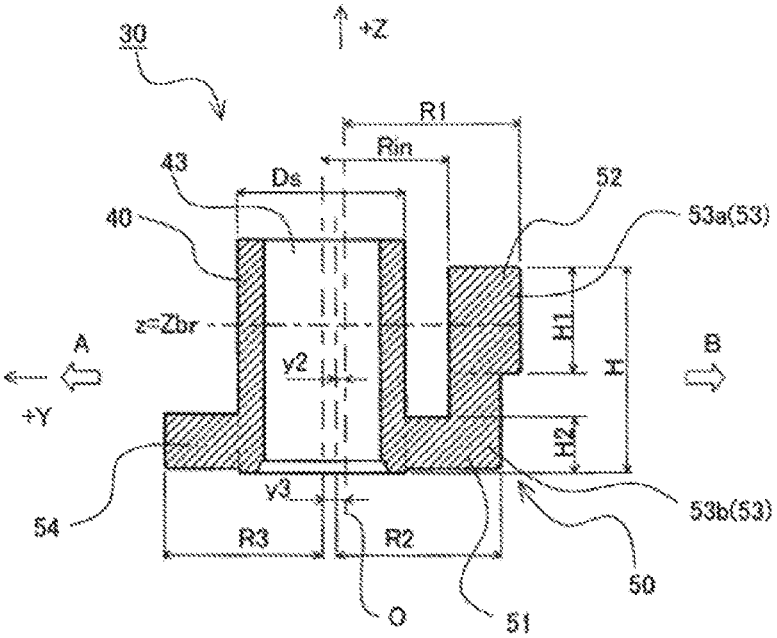
FIG. 3 is a sectional view taken along the line C-C of FIG. 2.
Figure 4:
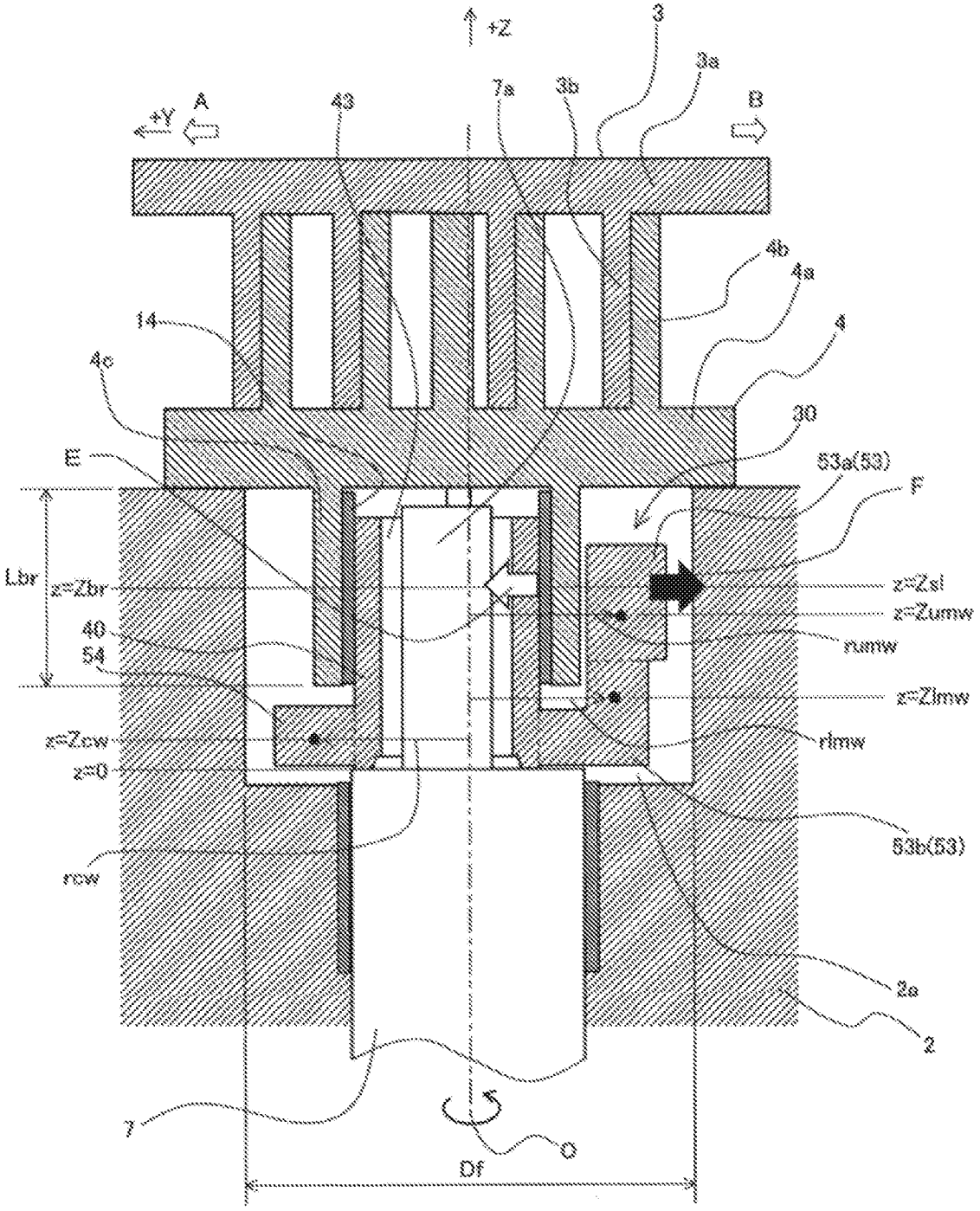
FIG. 4 is a schematic longitudinal sectional view illustrating the vicinity of the slider of the scroll compressor according to Embodiment 1 of the present invention and a position of a centrifugal force acting on the slider and a position where an oil film reactive force acts.

FIG. 2 is a plan view illustrating the slider of the scroll compressor according to Embodiment 1 of the present invention. FIG. 3 is a sectional view taken along the line C-C of FIG. 2. Further, FIG. 4 is a schematic vertical sectional view illustrating the vicinity of the slider of the scroll compressor according to Embodiment 1 of the present invention and is a schematic view illustrating a position of a centrifugal force acting on the slider and a position where an oil film reactive force acts. In this case, the outline arrow A illustrated in FIG. 2 to FIG. 4 represents the eccentric direction of the eccentric shaft portion 7*a* from the central axis of the spindle 7, that is, an eccentric direction of the rocking bearing 14 from the central axis of the spindle 7. Further, the outline arrow B illustrated in FIG. 2 to FIG. 4 represents a counter eccentric direction opposite to the eccentric direction. Note that, the eccentric direction is hereinafter referred to as a "Y-axis direction". Further, the central axis direction of the spindle 7, that is, the vertical direction is referred to as a "Z-axis direction".

The slider 30 constitutes a variable crank mechanism configured to change the radius of revolution of the orbiting scroll 4 depending on the lateral shape of the scroll lap 3*b* of the fixed scroll 3. The slider 30 has the cylindrical portion 40 supported by the rocking bearing 14 so that the cylindrical portion 40 rotates freely, and a balance weight portion 50 configured to cancel at least a part of the centrifugal force acting on the orbiting scroll 4. The slider 30 is received in a recess 2*a* formed in the frame 2. Note that the configuration of connection between the cylindrical portion 40 and the balance weight portion 50 is arbitrary. For example, the cylindrical portion 40 and the balance weight portion 50 may be connected by integrally molding the cylindrical portion 40 and the balance weight portion 50, in other words, by molding the cylindrical portion 40 and the balance weight portion 50 as a single part. Further, for example, the cylindrical portion 40 and the balance weight portion 50 may be connected by molding the cylindrical portion 40 and the balance weight portion 50 as separate parts and then fixing the cylindrical portion 40 and the balance weight portion 50 together. The cylindrical portion 40 and the balance weight portion 50 may be fixed together by means of, for example, bolts, pins, shrink fit, or press fitting.

The cylindrical portion 40 has an outer peripheral surface serving as a sliding surface against the rocking bearing 14 and having a cylindrical shape and an outside diameter Ds. The cylindrical portion 40 is supported by the rocking bearing 14 so that it rotates freely. The slide groove 43 having an elongated shape into which the eccentric shaft portion 7*a* is inserted so that it freely slides in one direction is formed on the inner periphery of the cylindrical portion 40. In this example, the direction in which the eccentric shaft portion 7*a* slides in the slide groove 43 is inclined relative to the eccentric direction of the orbiting scroll 4.

The balance weight portion 50 has a flat plate portion 51 and a protruding portion 52. The flat plate portion 51 is a substantially disc-shaped part having a thickness H2 and disposed around the outer periphery of the cylindrical portion 40 and is connected to the cylindrical portion 40. As illustrated in FIG. 1 and FIG. 4, an upper part of the cylindrical portion 40 is received in the rocking bearing 14. Therefore, the cylindrical portion 40 and the flat plate portion 51 are connected at a position spaced away from the orbiting scroll 4 relative to the rocking bearing 14 in the Z-axis direction, that is, below the rocking bearing 14. The protruding portion 52 is a part that protrudes toward the orbiting scroll 4, that is, upward from the flat plate portion 51. The protruding portion 52 is disposed closer to the counter eccentric direction relative to a center of rotation O of the slider 30. Further, the protruding portion 52 is disposed at a position spaced away by a radius Rin from the central axis of the cylindrical portion 40 (position shifted by y3 in the Y-axis direction from the center of rotation O of the slider 30) to avoid interference with the rocking bearing 14 and the boss 4*c*.

The overall balance weight portion 50 is provided eccentrically in the counter eccentric direction than the center of rotation O to cancel the centrifugal force on the orbiting scroll 4. At least a part of the centrifugal force on the orbiting scroll 4 is canceled by a centrifugal force on the balance weight portion 50, thereby reducing a radial load acting on the scroll lap 4*b* of the orbiting scroll 4. Therefore, it is possible to improve the reliability of the orbiting scroll 4 and to reduce a sliding loss between the scroll lap 4*b* of the orbiting scroll 4 and the scroll lap 3*b* of the fixed scroll 3.

In this case, when the slider 30 rotates, a center of action of the oil film reactive force generated between the rocking bearing 14 and the outer peripheral surface of the cylindrical portion 40 of the slider 30 is a center of the rocking bearing 14 in the Z-axis direction as represented by the outline arrow E of FIG. 4. Therefore, when the position of a center of action of the centrifugal force on the slider 30 and the position of the center of the rocking bearing 14 deviate from each other in the Z-axis direction, the slider 30 may be tilted so that the center of action of the oil film reactive force and the center of action of the centrifugal force coincide with each other, thereby causing a biased contact between the cylindrical portion 40 of the slider 30 and the rocking bearing 14. Thus, it is necessary to design the slider 30 in a shape in which the position of the center of action of the centrifugal force on the slider 30 and the position of the center of the rocking bearing 14 substantially coincide with each other in the Z-axis direction.

In this regard, a related-art scroll compressor has the following problem in an attempt to design the slider in the shape in which the position of the center of action of the centrifugal force on the slider and the position of the center of the rocking bearing substantially coincide with each other. That is, it is necessary to connect the cylindrical portion and the balance weight portion of the slider in an area where the rocking bearing is not present. In other words, the connection part where the cylindrical portion and the balance weight portion are connected is located in an area where the rocking bearing is not present. In a case of the vertical scroll compressor, the connection part where the cylindrical portion and the balance weight portion of the slider are connected is located below the rocking bearing. To bear the centrifugal force generated on the balance weight portion, the connection part needs to be thick to some extent in terms of strength. Therefore, when the slider rotates, the height position of the center of action of the centrifugal force on the slider tends to decrease downward due to the centrifugal force generated on the connection part. Thus, in order that the position of the center of action of the centrifugal force on the slider and the position of the center of the rocking bearing substantially coincide with each other, it is necessary to contribute a method for allowing the center of action of the centrifugal force on the slider closer to the orbiting scroll.

To solve this problem, in the vertical scroll compressor described in Patent Literature 1, there is proposed a structure in which the center of action of the centrifugal force on the slider is made closer to the orbiting scroll by using, in the balance weight portion, a high-density member near the orbiting scroll than the center of the rocking bearing and a low-density member near an area opposite the orbiting scroll. In this structure, however, an interface between the high-density member and the low-density member has a low strength, thereby causing a problem that the slider may be broken from the interface.

Further, in the vertical scroll compressor described in Patent Literature 1, there is proposed a structure in which the center of action of the centrifugal force on the slider is made closer to the orbiting scroll by increasing the height of the upper end of the balance weight portion compared with that of the cylindrical portion. In this structure, however, the following problems arise because the size of the slider increases. That is, when the upper end of the balance weight portion is positioned higher than that of the cylindrical portion, a stress applied to a root of the balance weight portion increases, thereby causing a problem that the reliability may decrease. Further, it is necessary that the length of the boss of the orbiting scroll where the rocking bearing is provided be increased along with the increase in the overall height of the balance weight portion. Therefore, when the height of the upper end of the balance weight portion is increased compared with that of the cylindrical portion, the amount of deformation of the boss of the orbiting scroll increases, thereby causing a problem that the performance of the scroll compressor may decrease. Further, the slider is received in the recess formed in the frame. Therefore, when the height of the upper end of the balance weight portion is increased compared with that of the cylindrical portion, it is necessary to increase the length of the frame as well. Thus, when the height of the upper end of the balance weight portion is increased compared with that of the cylindrical portion, material costs increase due to the increase in the lengths of the boss of the orbiting scroll and the frame, thereby causing a problem that the cost of the scroll compressor may increase. Further, the size of a space at a lower part of the frame, in which suction gas (low-pressure gas refrigerant) sucked into the sealed container is stored temporarily, decreases due to the increase in the length of the frame, thereby causing a problem of an increase in a pressure loss of the suction gas, an increase in the amount of outflow of oil, or other problems.

Further, in the vertical scroll compressor described in Patent Literature 1, there is proposed a structure in which the center of action of the centrifugal force on the slider is made closer to the orbiting scroll by sufficiently increasing the radius of the upper part of the balance weight portion compared with the radius of the lower part thereof. Also in this structure, however, the following problems arise because the size of the slider increases. That is, when the radius of the upper part of the balance weight portion is sufficiently increased compared with the radius of the lower part thereof, the centrifugal force generated on the balance weight portion increases excessively. Therefore, it is difficult to achieve both designing for setting an arbitrary degree of the centrifugal force and prevention of the tilt of the slider, thereby causing a problem that the reliability or performance of the scroll compressor may decrease. Due to the excessive increase in the centrifugal force generated on the balance weight portion, the stress applied to the root of the balance weight portion increases, thereby causing a problem that the reliability may decrease. Further, the size of the frame in which the slider is received increases along with the increase in the radius of the upper part of the balance weight portion. Therefore, the material costs increase, thereby causing a problem that the cost of the scroll compressor may increase.

In view of the above, in the scroll compressor 100 according to Embodiment 1, the balance weight portion 50 is structured as follows. Thus, the occurrence of the biased contact between the cylindrical portion 40 of the slider 30 and the rocking bearing 14 is reduced and the problems inherent in the scroll compressor described in Patent Literature 1 are solved.

Specifically, as illustrated in FIG. 2 to FIG. 4, the balance weight portion 50 of the slider 30 according to Embodiment 1 includes a main weight portion 53 provided at a position distant from the center of rotation O of the slider 30 in the counter eccentric direction, and a counter-weight portion 54 provided at a position distant from the center of rotation O of the slider 30 in the eccentric direction. Further, in Embodiment 1, the main weight portion 53 includes a first main weight portion 53*a* and a second main weight portion 53*b*.

The first main weight portion 53*a* is a part of the main weight portion 53 that is disposed near the orbiting scroll 4. That is, the first main weight portion 53*a* is a part that constitutes an upper part of the main weight portion 53. In Embodiment 1, the first main weight portion 53*a* falls within a range of a length H1 from the upper end in an overall height H of the main weight portion 53. That is, the first main weight portion 53*a* is constituted by a part of the protruding portion 52. In plan view (that is, in a state in which the first main weight portion 53*a* is observed in the Z-axis direction), the first main weight portion 53*a* has an arc-shaped outer peripheral surface. The outer peripheral surface is located on an outer side relative to the outer peripheral surface of the second main weight portion 53*b* described later. Thus, a Z-axis direction center of action of a resultant force of centrifugal forces generated on the first main weight portion 53*a* and the second main weight portion 53*b*, that is, a Z-axis direction center of action of a centrifugal force generated on the main weight portion 53 can be raised toward the orbiting scroll 4, that is, upward.

Note that, in the slider 30 according to Embodiment 1, as described later, the center of action in the Z-axis direction of the centrifugal force generated on the slider 30 can be raised toward the orbiting scroll 4 by the counter-weight portion 54. Therefore, unlike the slider described in Patent Literature 1, in the slider 30 according to Embodiment 1, there is no need to increase the radius of the outer periphery of the first main weight portion 53*a* to such an extent that the problems described above arise due to the increase in the size of the slider 30.

The second main weight portion 53*b* is a part of the main weight portion 53 that is disposed at a position spaced away from the orbiting scroll 4 relative to the first main weight portion 53*a*. That is, the second main weight portion 53*b* is constituted by a lower part of the protruding portion 52 and a part of the flat plate portion 51 that is provided at a position distant from the center of rotation O of the slider 30 in the counter eccentric direction. Thus, the second main weight portion 53*b* also functions as a connection part where the cylindrical portion 40 and the main weight portion 53 are connected. As described above, the second main weight portion 53*b* has an arc-shaped outer peripheral surface in plan view.

The counter-weight portion 54 is constituted by a part of the flat plate portion 51 that is provided at a position distant from the center of rotation O of the slider 30 in the eccentric direction. The counter-weight portion 54 is disposed at a position spaced away from the orbiting scroll 4 relative to the rocking bearing 14 in the Z-axis direction, that is, at a position spaced away from the orbiting scroll 4 relative to the position of the center of the rocking bearing 14 in the Z-axis direction. The counter-weight portion 54 has an arc-shaped outer peripheral surface in plan view.

In this case, the radii of the outer peripheral surfaces of the first main weight portion 53*a*, the second main weight portion 53*b*, and the counter-weight portion 54 may be equal to or different from each other. Further, the positions of centers of the radii of the outer peripheral surfaces of the first main weight portion 53*a*, the second main weight portion 53*b*, and the counter-weight portion 54 may be identical or different. In Embodiment 1, at least one of the first main weight portion 53*a*, the second main weight portion 53*b*, and the counter-weight portion 54 is set different from the other weight portions in terms of the radii of the outer peripheral surfaces and the positions of the centers of the radii to improve the degree of freedom in terms of designing of the slider 30.

Specifically, in Embodiment 1, the radii of the outer peripheral surfaces of the first main weight portion 53*a*, the second main weight portion 53*b*, and the counter-weight portion 54 and the positions of the centers are set as illustrated in FIG. 2 and FIG. 3. That is, the outer peripheral surface of the first main weight portion 53*a* has an arc shape with a radius R1 around the center of rotation O of the slider 30. The outer peripheral surface of the second main weight portion 53*b* has an arc shape with a radius R2 around a position shifted by y2 in the Y-axis direction from the center of rotation O of the slider 30 in the counter eccentric direction. The outer peripheral surface of the counter-weight portion 54 has an arc shape with a radius R3 around a position shifted in the eccentric direction by y3 in the Y-axis direction from the center of rotation O of the slider 30 in the eccentric direction.

In the slider 30 configured as described above, when the slider 30 rotates about the center of rotation O, the following centrifugal force is generated on the slider 30. That is, when the main weight portion 53 rotates about the center of rotation O, a centrifugal force in the counter eccentric direction is generated on the slider. Note that, as described above, in Embodiment 1, the outer peripheral surface of the first main weight portion 53*a* is located on the outer side relative to the outer peripheral surface of the second main weight portion 53*b*. That is, a centrifugal force (sectional area×centroid distance) per unit thickness of the first main weight portion 53*a* is greater than a centrifugal force (sectional area×centroid distance) per unit thickness of the second main weight portion 53*b*. Thus, the Z-axis direction center of action of the resultant force of the centrifugal forces generated on the first main weight portion 53*a* and the second main weight portion 53*b*, that is, the center of action in the Z-axis direction of the centrifugal force generated on the main weight portion 53 can be raised toward the orbiting scroll 4, that is, upward.

When the counter-weight portion 54 rotates about the center of rotation O, on the other hand, a centrifugal force in the eccentric direction is generated at a position spaced away from the orbiting scroll 4 relative to the position of the center of the rocking bearing 14 in the Z-axis direction. With this centrifugal force, a centrifugal force generated at a position spaced away from the orbiting scroll 4 in the centrifugal force generated on the main weight portion 53 can be canceled mainly. Thus, the center of action in the Z-axis direction of the centrifugal force generated on the overall slider 30 closer to the counter eccentric direction can be raised toward the orbiting scroll 4, that is, upward.

Therefore, the centrifugal force for canceling at least a part of the centrifugal force on the orbiting scroll 4 can be generated at a position that substantially coincides with the position of the center of the rocking bearing 14 in the Z-axis direction by appropriately setting the height dimensions of the first main weight portion 53*a*, the second main weight portion 53*b*, and the counter-weight portion 54, the radii of the outer peripheral surfaces thereof, and the positions of the centers of the radii. That is, in the slider 30 according to Embodiment 1, it is possible to reduce the radial load acting on the scroll lap 4*b* of the orbiting scroll 4 and to prevent the occurrence of the biased contact between the cylindrical portion 40 of the slider 30 and the rocking bearing 14.

Specifically, when the slider 30 slides while rotating in the rocking bearing 14, the oil film reactive force is generated between the rocking bearing 14 and the outer peripheral surface of the cylindrical portion 40 of the slider 30. As represented by the outline arrow E of FIG. 4, the center of action in the Z-axis direction of the oil film reactive force coincides with the center of the rocking bearing 14 in a state in which the cylindrical portion 40 and the rocking bearing 14 are kept parallel to each other. Therefore, as represented by the solid arrow F of FIG. 4, the center of action in the Z-axis direction of the centrifugal force on the slider 30 is made to substantially coincide with the position of the center of the rocking bearing 14 in the Z-axis direction. Thus, no tilting moment is generated on the slider 30 and accordingly the cylindrical portion 40 of the slider 30 and the rocking bearing 14 can slide while being kept parallel to each other.

In order that the center of action in the Z-axis direction of the centrifugal force on the slider 30 substantially coincide with the position of the center of the rocking bearing 14 in the Z-axis direction, it is appropriate to determine the shape of the slider 30 so that Expression (1) and Expression (2) are satisfied.

$$Xsl \approx Zbr \tag{1}$$

$$Zsl=\{(Mumw\times rumw\times Zumw)+(Mlmw\times rlmw\times Zimw)-(Mcw\times rcw\times Zcw)\}/\{(Mumw\times rumw)+(Mlmw\times rlmw)-(Mcw\times rcw)\} \tag{2}$$

Zsl: Z coordinate of center of action of centrifugal force on slider 30,

Zbr: Z coordinate of center of rocking bearing 14,

Mumw: mass of first main weight portion 53*a*, rumw: radial distance from center of rotation O to center of gravity of first main weight portion 53*a*, Zumw: Z coordinate of center of gravity of first main weight portion 53*a*, Mlmw: mass of second main weight portion 53*b*, rlmw: radial distance from center of rotation O to center of gravity of second main weight portion 53*b*, Zlmw: Z coordinate of center of gravity of second main weight portion 53*b*, Mcw: mass of counter-weight portion 54, rcw: radial distance from center of rotation O to center of gravity of counter-weight portion 54, Zcw: Z coordinate of center of gravity of counter-weight portion 54.

When the scroll compressor 100 is configured so that the center of action in the Z-axis direction of the centrifugal force on the slider 30 completely coincides with the position of the center of the rocking bearing 14 in the Z-axis direction, the cylindrical portion 40 of the slider 30 and the rocking bearing 14 are kept parallel to each other. When the cylindrical portion 40 of the slider 30 and the rocking bearing 14 are kept parallel to each other, it is possible to completely prevent the occurrence of the biased contact between the cylindrical portion 40 of the slider 30 and the rocking bearing 14. Thus, when the scroll compressor 100 is configured so that the center of action in the Z-axis direction of the centrifugal force on the slider 30 completely coincides with the position of the center of the rocking bearing 14 in the Z-axis direction, it is possible to completely prevent the occurrence of the biased contact between the cylindrical portion 40 of the slider 30 and the rocking bearing 14. When the center of action in the Z-axis direction of the centrifugal force on the slider 30 completely coincides with the position of the center of the rocking bearing 14 in the Z-axis direction, Expression (1) is Zsl=Zbr.

For example, when there is any restriction on the design dimensions of the slider 30 as in a case in which downsizing of the slider 30 is required, on the other hand, it may be difficult to design the slider 30 so that Expression (1) is Zsl=Zbr.

Figure 5:
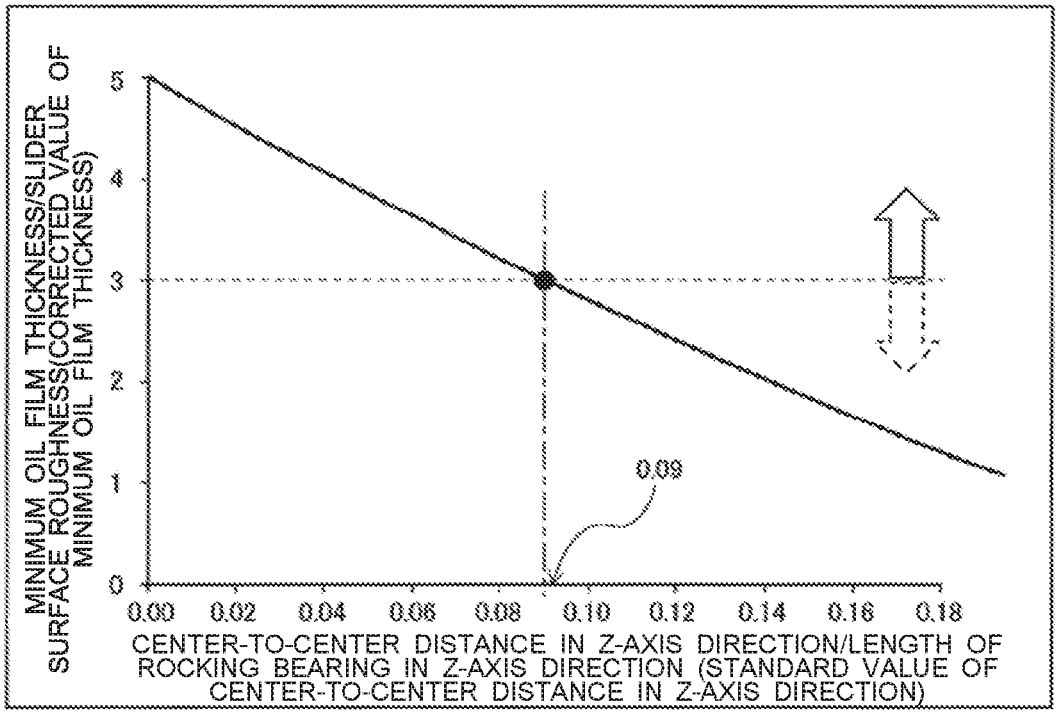
FIG. 5 is a graph illustrating, with a solid line, a relationship between a distance in a Z-axis direction between a center of action of a centrifugal force on the slider and a center of a rocking bearing and a minimum oil film thickness between the rocking bearing and the outer peripheral surface of a cylindrical portion of the slider under a high-oil temperature condition.

FIG. 5 is a graph illustrating, with a solid line, a relationship between a distance in the Z-axis direction between the center of action of the centrifugal force on the slider and the center of the rocking bearing 14 and a minimum oil film thickness between the rocking bearing 14 and the outer peripheral surface of the cylindrical portion 40 of the slider 30 under a high-oil temperature condition. The description "under a high-oil temperature condition" herein refers to an oil temperature condition in which the oil film thickness is difficult to be secured on the rocking bearing 14. Under the high-oil temperature condition, the viscosity of the lubricating oil becomes lower than that under a normal oil temperature condition and the oil film thickness of the lubricating oil decreases. Further, in the following description, the "distance in the Z-axis direction between the center of action of the centrifugal force on the slider 30 and the center of the rocking bearing 14 (|Zsl−Zbr|)" may be abbreviated to a "center-to-center distance in the Z-axis direction". Further, in the following description, the "minimum oil film thickness between the rocking bearing 14 and the outer peripheral surface of the cylindrical portion 40 of the slider 30" may be abbreviated as a "minimum oil film thickness on the rocking bearing 14".

The horizontal axis in the graph of FIG. 5 represents a standard value of the center-to-center distance in the Z-axis direction (|Zsl−Zbr|). This value is standardized by dividing the center-to-center distance in the Z-axis direction (|Zsl−Zbr|) by the length of the rocking bearing 14 in the Z-axis direction (Lbr). That is, the horizontal axis in the graph of FIG. 5 represents the ratio (|Zsl−Zbr|/Lbr) of the center-to-center distance in the Z-axis direction (|Zsl−Zbr|) to the length of the rocking bearing 14 in the Z-axis direction (Lbr). Note that FIG. 4 illustrates the length of the rocking bearing 14 in the Z-axis direction (Lbr).

Further, the vertical axis in the graph of FIG. 5 represents a corrected value of the minimum oil film thickness, which shows the minimum oil film thickness on the rocking bearing 14. The minimum oil film thickness is corrected by dividing an actual minimum oil film thickness on the rocking bearing 14 by the roughness of the outer peripheral surface of the cylindrical portion 40 of the slider 30. That is, the vertical axis in the graph of FIG. 5 represents the ratio of the actual minimum oil film thickness on the rocking bearing 14 to the roughness of the outer peripheral surface of the cylindrical portion 40 of the slider 30.

In the scroll compressor 100, the rotational moment generated on the slider 30 increases as the center-to-center distance in the Z-axis direction (|Zsl−Zbr|) increases. Therefore, the inclination of the slider 30 relative to the Z-axis direction increases. When the center-to-center distance in the Z-axis direction is set to a constant value, the amount of the lubricating oil on the rocking bearing 14 decreases as the length of the rocking bearing 14 in the Z-axis direction (Lbr) decreases. Therefore, the influence exerted on the minimum oil film thickness by the rotational moment generated on the slider 30 increases. Further, when the inclination of the slider 30 relative to the Z-axis direction increases, the minimum oil film thickness on the rocking bearing 14 decreases. Thus, as represented by the solid line in FIG. 5, the minimum oil film thickness on the rocking bearing 14 decreases as the ratio (|Zsl−Zbr|/Lbr) of the center-to-center distance in the Z-axis direction (|Zsl−Zbr|) to the length of the rocking bearing 14 in the Z-axis direction (Lbr) increases.

In FIG. 5, a threshold at which the slider 30 can completely keep sliding via the oil film of the lubricating oil on the rocking bearing 14 under the high-oil temperature condition is represented by the dotted line parallel to the horizontal axis in the graph. As represented by the block arrow in the dotted line of FIG. 5, a range in which the corrected value of the minimum oil film thickness is smaller than 3 is a mixed lubrication range, in which the rocking bearing 14 has a part where the slider 30 slides without intermediation of the oil film of the lubricating oil, or a boundary lubrication range, in which the slider 30 slides without intermediation of the oil film of the lubricating oil. Thus, in the range in which the corrected value of the minimum oil film thickness is smaller than 3, a contact without intermediation of the oil film occurs between the cylindrical portion 40 of the slider 30 and the rocking bearing 14, thereby causing wear of the cylindrical portion 40 of the slider 30 and the rocking bearing 14. As a result, the reliability of the rocking bearing 14 cannot be secured.

As represented by the block arrow in the solid line of FIG. 5, on the other hand, a range in which the corrected value of the minimum oil film thickness is equal to or larger than 3 is a lubrication range, in which the slider 30 can completely keep sliding via the oil film of the lubricating oil on the rocking bearing 14. Thus, in the range in which the corrected value of the minimum oil film thickness is equal to or larger than 3, the sliding between the cylindrical portion 40 of the slider 30 and the rocking bearing 14 via the oil film can be kept, thereby preventing the occurrence of wear. As a result, the reliability of the rocking bearing 14 can be secured.

In this case, the ratio (|Zsl−Zbr|/Lbr) of the center-to-center distance in the Z-axis direction (|Zsl−Zbr|) to the length of the rocking bearing 14 in the Z-axis direction (Lbr) at the intersection of the solid line and the dotted line in FIG. 5 is 0.09 as represented by the chain line in FIG. 5. That is, when the ratio (|Zsl−Zbr|/Lbr) is equal to or smaller than 0.09, the inclination of the slider 30 relative to the Z-axis direction can be kept small. Thus, the slider 30 can completely keep sliding via the oil film of the lubricating oil on the rocking bearing 14. Accordingly, to secure the reliability of the rocking bearing 14, it is appropriate that the distance in the Z-axis direction between the center of action of the centrifugal force on the slider 30 and the center of the rocking bearing 14 (|Zsl−Zbr|) be equal to or smaller than 0.09 times the length of the rocking bearing 14 in the Z-axis direction (Lbr).

Thus, when the shape of the slider 30 is determined so that Expression (3) is satisfied, the slider 30 can completely keep sliding via the oil film of the lubricating oil on the rocking bearing 14 even under the high-oil temperature condition. As a result, the reliability of the rocking bearing 14 can be kept. Thus, when the shape of the slider 30 is determined so that Expression (3) is satisfied, the reliability of the scroll compressor 100 can be secured even under the high-oil temperature condition, in which the oil film thickness is difficult to secure on the rocking bearing 14.

$$|Zsl-Zbr|/Lbr \leq 0.09 \quad (3)$$

As described above, in the scroll compressor 100 configured as in Embodiment 1, the centrifugal force on the slider 30 for canceling at least a part of the centrifugal force on the orbiting scroll 4 can be generated at a position that substantially coincides with the position of the center of the rocking bearing 14 in the Z-axis direction. That is, in the scroll compressor 100 according to Embodiment 1, it is possible to reduce the radial load acting on the scroll lap 4*b* of the orbiting scroll 4 and to prevent the occurrence of the biased contact between the cylindrical portion 40 of the slider 30 and the rocking bearing 14.

At this time, in the scroll compressor 100 according to Embodiment 1, the centrifugal force generated on the slider 30 can be made closer to the orbiting scroll 4 by the counter-weight portion 54. Therefore, the position of the Z-axis direction center of the centrifugal force generated on the slider 30 and the position of the center of the rocking bearing 14 in the Z-axis direction can be made to substantially coincide with each other. Thus, in the scroll compressor 100 according to Embodiment 1, an increase in the size of the slider 30 can be suppressed and the problems inherent to the scroll compressor described in Patent Literature 1 can be solved.

Further, in the scroll compressor 100 according to Embodiment 1, at least one of the first main weight portion 53*a*, the second main weight portion 53*b*, and the counter-weight portion 54 is set different from the other weight portions in terms of the radii of the outer peripheral surfaces and the positions of the centers of the radii to improve the degree of freedom in terms of designing of the slider 30. Therefore, in the scroll compressor 100 according to Embodiment 1, the degree of freedom in terms of designing of the slider 30 is improved. Thus, the slider 30 is downsized more easily and the problems inherent in the scroll compressor described in Patent Literature 1 are solved more easily as well.

Embodiment 2

The shape of the slider 30 according to the present invention is not limited to that described in Embodiment 1. In Embodiment 2 and Embodiment 3 to Embodiment 6, examples of other shapes of the slider 30 according to the present invention are described. Note that items that are not particularly described in Embodiment 2 are similar to those of Embodiment 1 and the same functions or structures are described by using the same reference signs.

Figure 6:
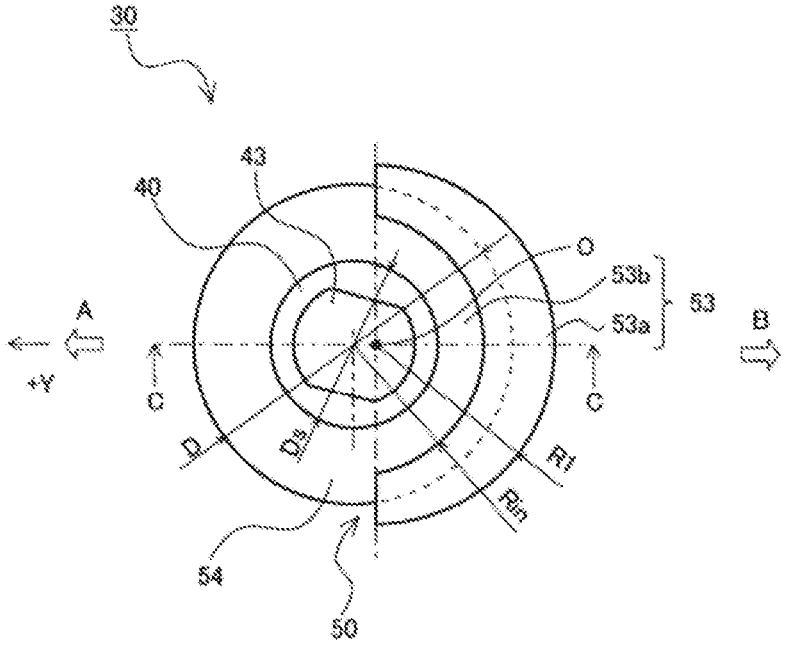
FIG. 6 is a plan view illustrating a slider of a scroll compressor according to Embodiment 2 of the present invention.
Figure 7:
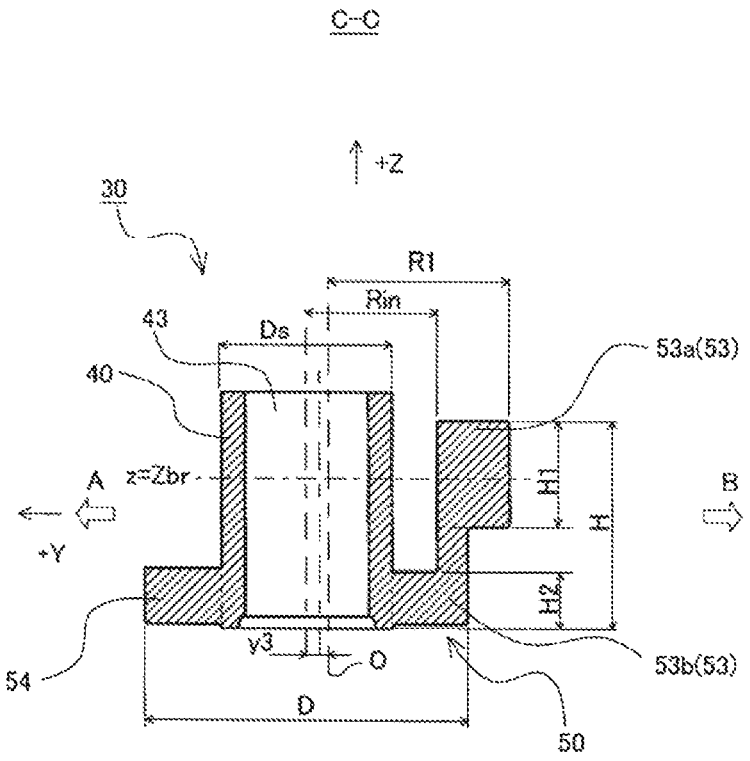
FIG. 7 is a sectional view taken along the line C-C of FIG. 6.

FIG. 6 is a plan view illustrating a slider of a scroll compressor according to Embodiment 2 of the present invention. Further, FIG. 7 is a sectional view taken along the line C-C of FIG. 6.

In the slider 30 according to Embodiment 2, in plan view, the outer peripheral surface of the second main weight portion 53*b* and the outer peripheral surface of the counter-weight portion 54 are located on an identical circle having a diameter D. That is, the second main weight portion 53*b* and the counter-weight portion 54 are identical to each other in terms of the radii of the outer peripheral surfaces and the positions of the centers. Further, in Embodiment 2, the positions of the centers of the outer peripheral surfaces of the second main weight portion 53*b* and the counter-weight portion 54 are set to positions identical to the position of the center of the outer peripheral surface of the cylindrical portion 40 (position shifted by y3 in the Y direction from the center of rotation O of the slider 30).

Therefore, in the slider 30 according to Embodiment 2, when the slider 30 is manufactured by using a lathe or other tools, the cylindrical portion 40, the second main weight portion 53*b*, and the counter-weight portion 54 can be formed without fixing a material for the slider 30 to a chuck again. Thus, the processability of the slider 30 can be improved.

Note that the processability of the slider 30 can further be improved when the position of the center of the outer peripheral surface of the first main weight portion 53*a* is made to coincide with the positions of the centers of the outer peripheral surfaces of the cylindrical portion 40, the second main weight portion 53*b*, and the counter-weight portion 54.

Embodiment 3

Figure 8:
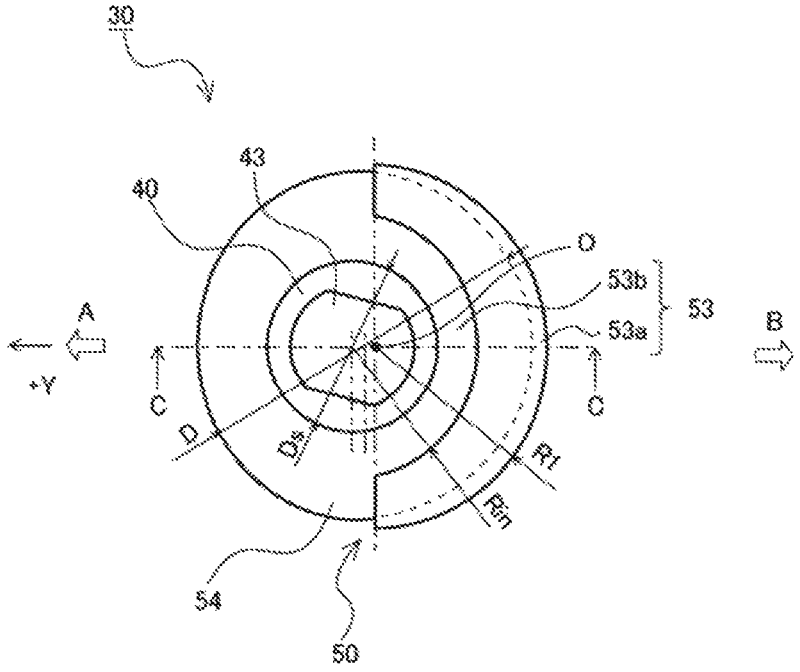
FIG. 8 is a plan view illustrating a slider of a scroll compressor according to Embodiment 3 of the present invention.
Figure 9:
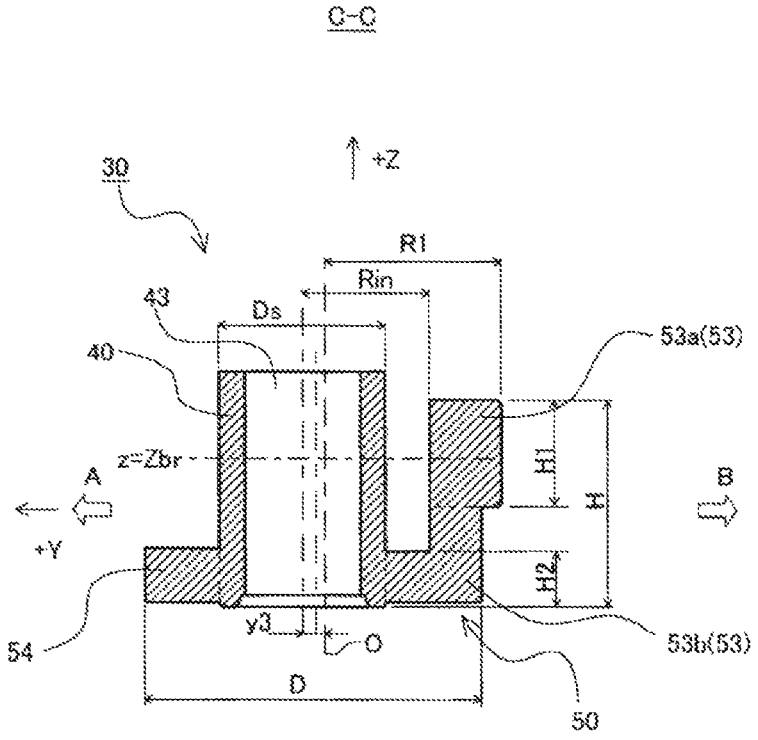
FIG. 9 is a sectional view taken along the line C-C of FIG. 8.

FIG. 8 is a plan view illustrating a slider of a scroll compressor according to Embodiment 3 of the present invention. Further, FIG. 9 is a sectional view taken along the line C-C of FIG. 8. Note that items that are not particularly described in Embodiment 3 are similar to those of Embodiment 1 or Embodiment 2 and the same functions or structures are described by using the same reference signs.

In the slider 30 according to Embodiment 3, in plan view, the outer peripheral surface of the second main weight portion 53*b* and the outer peripheral surface of the counter-weight portion 54 are located on an identical circle having the diameter D. That is, the second main weight portion 53*b* and the counter-weight portion 54 are identical to each other in terms of the radii of the outer peripheral surfaces and the positions of the centers. The positions of the centers of the outer peripheral surfaces of the second main weight portion 53*b* and the counter-weight portion 54 are arbitrary but are, for example, at the center of rotation O or at a position distant from the center of rotation O in the eccentric direction.

Since the outer peripheral surface of the second main weight portion 53*b* and the outer peripheral surface of the counter-weight portion 54 are located on the identical circle, those portions can be formed as a single columnar member when the slider 30 is manufactured by using a lathe or other tools. Thus, the processability of the slider 30 can be improved.

Embodiment 4

Figure 10:
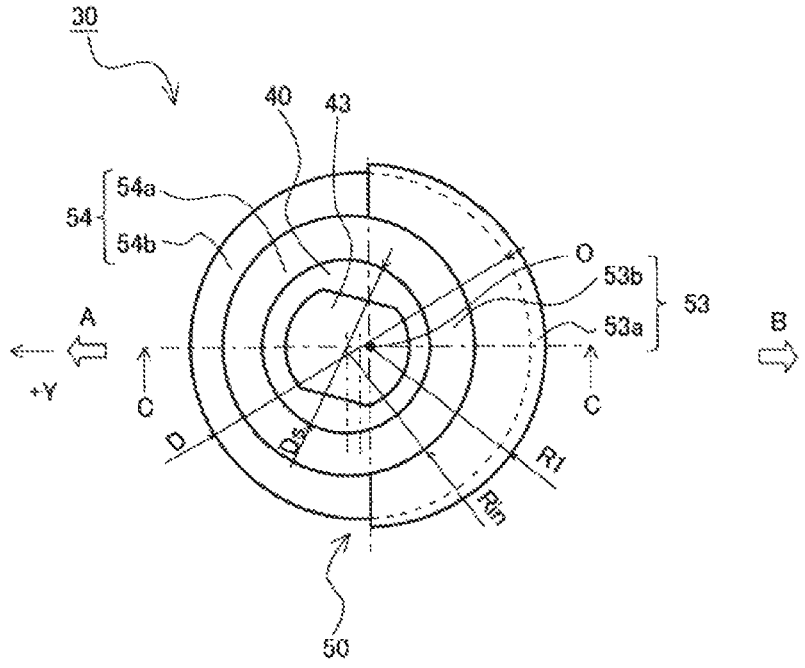
FIG. 10 is a plan view illustrating a slider of a scroll compressor according to Embodiment 4 of the present invention.
Figure 11:
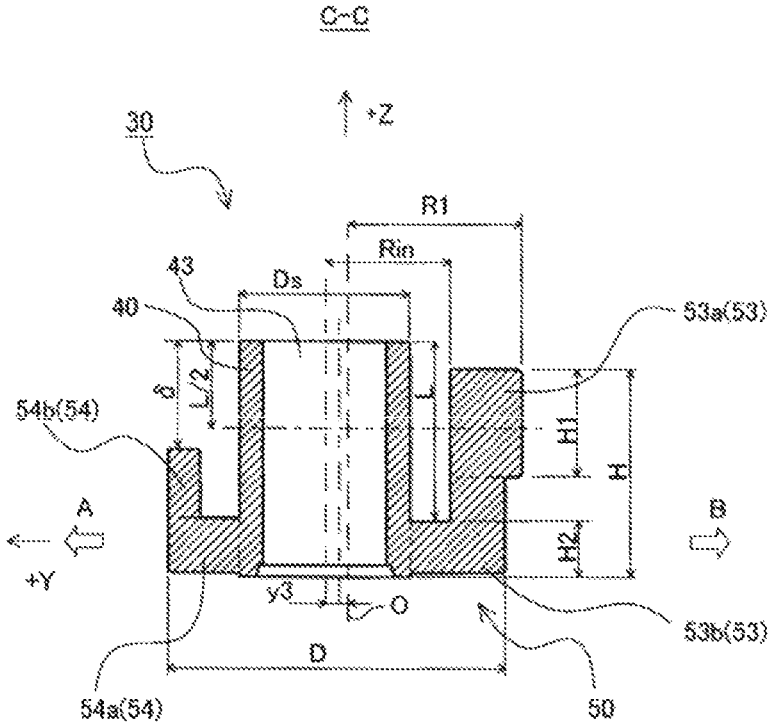
FIG. 11 is a sectional view taken along the line C-C of FIG. 10.

FIG. 10 is a plan view illustrating a slider of a scroll compressor according to Embodiment 4 of the present invention. Further, FIG. 11 is a sectional view taken along the line C-C of FIG. 10. Note that items that are not particularly described in Embodiment 4 are similar to those of any one of Embodiment 1 to Embodiment 3 and the same functions or structures are described by using the same reference signs.

The counter-weight portion 54 of the slider 30 according to Embodiment 4 includes a first counter-weight portion 54*a* connected to the cylindrical portion 40, and a second counter-weight portion 54*b* that protrudes from the first counter-weight portion 54*a* toward the orbiting scroll 4. In this case, when L represents a distance in the Z-axis direction from the end of the cylindrical portion 40 near the orbiting scroll 4 to a part where the cylindrical portion 40 and the first counter-weight portion 54*a* are connected, the end of the second counter-weight portion 54*b* near the orbiting scroll 4 is spaced away by L/2 or longer from the end of the cylindrical portion 40 near the orbiting scroll 4 toward the first counter-weight portion 54*a*. In other words, a distance 5 between the end of the second counter-weight portion 54*b* near the orbiting scroll 4 and the end of the cylindrical portion 40 near the orbiting scroll 4 is represented as follows.

$$\delta \leq L/2 \quad (4)$$

In the counter-weight portion 54 configured as described above, at a position spaced away from the orbiting scroll 4 relative to the position of the center of the rocking bearing 14 in the Z-axis direction, the centrifugal force generated in the eccentric direction can be increased without increasing the radius of the outer peripheral surface of the counter-weight portion 54. Therefore, in the slider 30 according to Embodiment 4, the degree of freedom in terms of designing of the slider 30 is improved. Thus, the slider 30 is downsized more easily and the problems inherent to the scroll compressor described in Patent Literature 1 are solved more easily as well.

Embodiment 5

Figure 12:
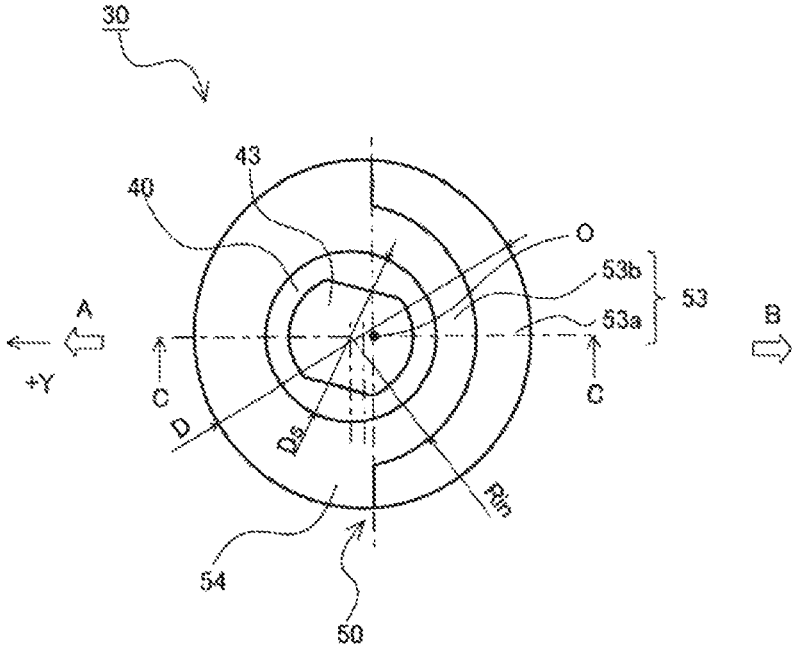
FIG. 12 is a plan view illustrating a slider of a scroll compressor according to Embodiment 5 of the present invention.
Figure 13:
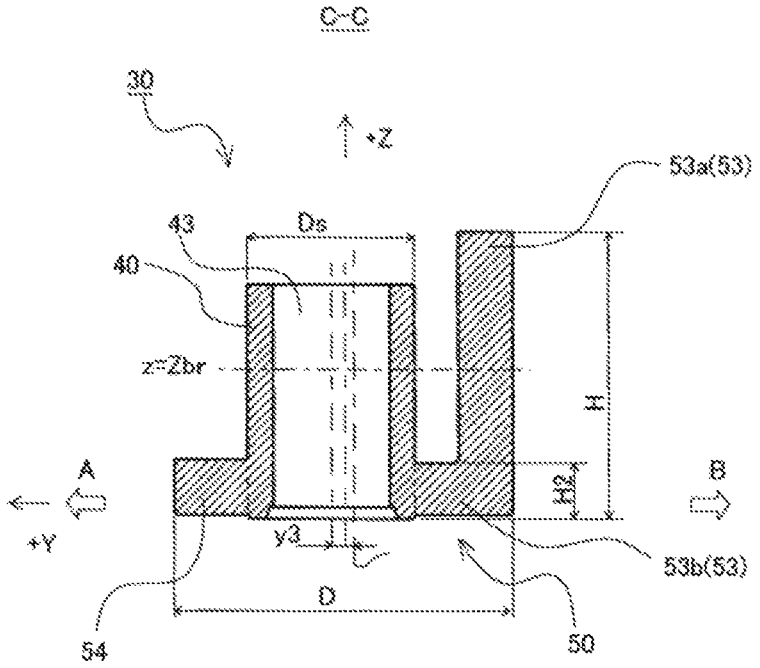
FIG. 13 is a sectional view taken along the line C-C of FIG. 12.

FIG. 12 is a plan view illustrating a slider of a scroll compressor according to Embodiment 5 of the present invention. Further, FIG. 13 is a sectional view taken along the line C-C of FIG. 12. Note that items that are not particularly described in Embodiment 5 are similar to those of any one of Embodiment 1 to Embodiment 4 and the same functions or structures are described by using the same reference signs.

In the slider 30 according to Embodiment 5, in plan view, the outer peripheral surface of the main weight portion 53 and the outer peripheral surface of the counter-weight portion 54 are located on an identical circle having the diameter D. That is, in the slider 30 according to Embodiment 5, in plan view, the outer peripheral surface of the first main weight portion 53*a*, the outer peripheral surface of the second main weight portion 53*b*, and the outer peripheral surface of the counter-weight portion 54 are located on the identical circle having the diameter D. That is, the main weight portion 53 and the counter-weight portion 54 are identical to each other in terms of the radii of the outer peripheral surfaces and the positions of the centers. The positions of the centers of the outer peripheral surfaces of the main weight portion 53 and the counter-weight portion 54 are arbitrary but are, for example, at the center of rotation O or at a position distant from the center of rotation O in the eccentric direction.

Since the outer peripheral surface of the main weight portion 53 and the outer peripheral surface of the counter-weight portion 54 are located on the identical circle, those portions can be formed as a single columnar member when the slider 30 is manufactured by using a lathe or other tools. Thus, the processability of the slider 30 can be improved.

Further, the processability of the slider 30 can further be improved when the position of the center of the outer peripheral surface of the cylindrical portion 40 is made to coincide with the positions of the centers of the outer peripheral surfaces of the main weight portion 53 and the counter-weight portion 54.

Note that, in the slider 30 according to Embodiment 5, the upper end of the main weight portion 53 is positioned higher than that of the upper end of the cylindrical portion 40. In the slider 30 according to Embodiment 1, however, as described above, the center of action of the centrifugal force in the Z-axis direction generated on the slider 30 can be raised toward the orbiting scroll 4 by the counter-weight portion 54. Therefore, in the slider 30 according to Embodiment 5, there is no particular need to increase the height of the upper end of the main weight portion 53 compared with that of the upper end of the cylindrical portion 40.

Embodiment 6

Figure 14:
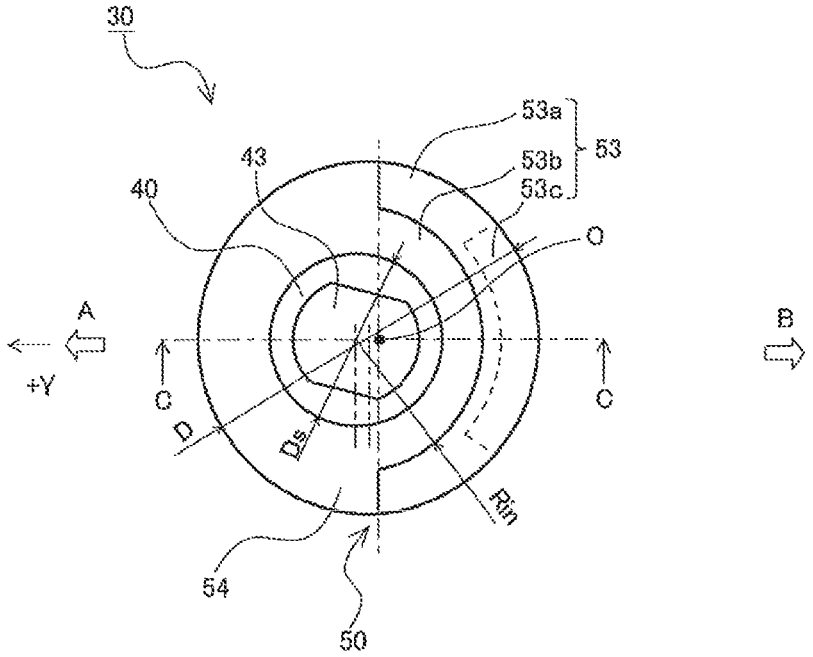
FIG. 14 is a plan view illustrating a slider of a scroll compressor according to Embodiment 6 of the present invention.
Figure 15:
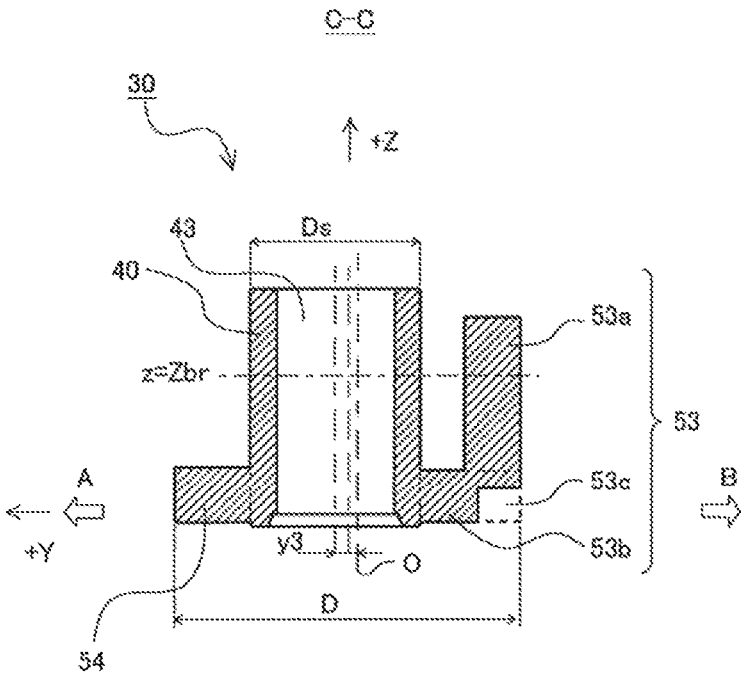
FIG. 15 is a sectional view taken along the line C-C of FIG. 14.

FIG. 14 is a plan view illustrating a slider of a scroll compressor according to Embodiment 6 of the present invention. Further, FIG. 15 is a sectional view taken along the line C-C of FIG. 14. Note that items that are not particularly described in Embodiment 6 are similar to those of any one of Embodiment 1 to Embodiment 5 and the same functions or structures are described by using the same reference signs.

In the slider 30 according to Embodiment 6, the main weight portion 53 has a hollow portion 53*c* provided below the center of the rocking bearing 14 (Zbr) in the Z-axis direction. For example, the hollow portion 53*c* may be a recess provided in the outer peripheral surface of the main weight portion 53 in a circumferential direction. When the hollow portion 53*c* is a recess, for example, as illustrated in FIG. 14 and FIG. 15, the hollow portion 53*c* may be provided at the lower end of the outer peripheral surface of the main weight portion 53 as a recess having an L-shape in cross section.

Since the main weight portion 53 has the hollow portion 53*c* provided below the center of the rocking bearing 14 in the Z-axis direction, the Z-axis direction center of action of the centrifugal force generated on the slider 30 can be made even closer to the orbiting scroll 4. Thus, since the main weight portion 53 has the hollow portion 53*c* provided below the center of the rocking bearing 14 in the Z-axis direction, the width of the main weight portion 53 in the Z-axis direction is reduced and the balance weight portion 50 can be downsized.

Further, advantages similar to those described above can be attained irrespective of whether the hollow portion 53*c* is located in the first main weight portion 53*a* or in the second main weight portion 53*b* as long as the hollow portion 53*c* is provided at a position below the center of the rocking bearing 14 in the Z-axis direction. Further, advantages similar to those described above can be attained also when the hollow portion 53*c* is provided as, for example, a hollow space inside the main weight portion 53 as long as the hollow portion 53*c* is provided at a position below the center of the rocking bearing 14 in the Z-axis direction. Further, advantages similar to those described above can be attained also when a plurality of hollow portions 53*c* are provided as long as the hollow portions 53*c* are provided at positions below the center of the rocking bearing 14 in the Z-axis direction.

Further, when the hollow portion 53*c* is a recess provided in the outer peripheral surface of the main weight portion 53 in the circumferential direction, the processability of the slider 30 can be improved in the manufacture of the slider 30 that uses a lathe or other tools.

Note that the shape of the recess is not limited to the L-shape in cross section as exemplified in FIG. 14 and FIG. 15. For example, also when a recess having a U-shape in cross section is provided in the outer peripheral surface of the main weight portion 53, it is possible to attain an advantage similar to that described above, that is, an advantage that the processability of the slider 30 can be improved.

Other Embodiments

The examples of the scroll compressor according to the present invention are described above in Embodiment 1 to Embodiment 6 but the structure of the scroll compressor is not limited to the structures described above in Embodiment 1 to Embodiment 6 and various modifications may be made to the scroll compressor according to the present invention. For example, in Embodiment 1 to Embodiment 6, the vertical scroll compressor, in which the central axis of the spindle 7 runs in the vertical direction, is exemplified as the scroll compressor according to the present invention. The scroll compressor is not limited to the vertical scroll compressor and the present invention may be applied to a horizontal scroll compressor, in which the central axis of the spindle 7 runs while being inclined relative to the vertical direction. That is, the advantages described above in Embodiment 1 to Embodiment 6 can be attained by adopting the slider 30 according to the present invention in the horizontal scroll compressor.

Further, the structures described above in Embodiment 1 to Embodiment 6 may be applied in combination.

The invention claimed is:

1. A scroll compressor, comprising:

a fixed scroll;

an orbiting scroll configured to orbit relative to the fixed scroll;

a spindle configured to transfer a rotational driving force to the orbiting scroll;

an eccentric shaft portion provided at one end of the spindle and offset in an eccentric direction from a central axis of the spindle;

a slider having a slide groove formed therein so that the eccentric shaft portion is inserted into the slide groove so that the eccentric shaft portion slides freely; and a rocking bearing provided on the orbiting scroll to support the slider so that the slider rotates freely, wherein the slider comprises:

a cylindrical portion supported by the rocking bearing to rotate freely; and a balance weight portion connected to the cylindrical portion, wherein, when a direction opposite to the eccentric direction is a counter eccentric direction and a direction of the central axis is a Z-axis direction, the balance weight portion comprises:

a main weight portion provided at a position distant from a center of rotation of the slider in the counter eccentric direction; and a counter-weight portion provided at a position spaced away from the orbiting scroll than a center of the rocking bearing in the Z-axis direction and at a position distant from the center of rotation of the slider in the eccentric direction, wherein a center of action in the Z-axis direction of a centrifugal force on the slider does not coincide with a center of action of the rocking bearing in the Z-axis direction, and wherein a distance in the Z-axis direction between a center of action of a centrifugal force on the slider and the center of the rocking bearing is equal to, or smaller than, 0.09 times a length of the rocking bearing in the Z-axis direction.

2. The scroll compressor of claim 1, wherein the main weight portion comprises:

a first main weight portion disposed toward the orbiting scroll in the Z-axis direction; and a second main weight portion disposed at a position spaced away from the orbiting scroll than the first main weight portion in the Z-axis direction, wherein the first main weight portion, the second main weight portion, and the counter-weight portion have arc-shaped outer peripheral surfaces, and wherein at least one of the first main weight portion, the second main weight portion, and the counter-weight portion is different from other weight portions in terms of radii of the outer peripheral surfaces and positions of centers of the radii.

3. The scroll compressor of claim 1, wherein the main weight portion comprises:

a first main weight portion disposed toward the orbiting scroll in the Z-axis direction; and a second main weight portion disposed at a position spaced away from the orbiting scroll than the first main weight portion in the Z-axis direction, wherein the second main weight portion and the counter-weight portion have arc-shaped outer peripheral surfaces, and wherein the outer peripheral surface of the second main weight portion and the outer peripheral surface of the counter-weight portion are located on an identical circle.

4. The scroll compressor of claim 3, wherein at least one of a position of a center of an outer peripheral surface of the cylindrical portion and a position of a center of the first main weight portion is a position identical to positions of centers of the outer peripheral surfaces of the second main weight portion and the counter-weight portion.

5. The scroll compressor of claim 1, wherein the main weight portion and the counter-weight portion have arc-shaped outer peripheral surfaces, and wherein the outer peripheral surface of the main weight portion and the outer peripheral surface of the counter-weight portion are located on an identical circle.

6. The scroll compressor of claim 5, wherein a position of a center of an outer peripheral surface of the cylindrical portion and positions of centers of the outer peripheral surfaces of the main weight portion and the counter-weight portion are identical positions.

7. The scroll compressor of claim 1, wherein, when L represents a distance in the Z-axis direction from an end of the cylindrical portion near the orbiting scroll to a part where the cylindrical portion and the counter-weight portion are connected, the counter-weight portion comprises:

a first counter-weight portion connected to the cylindrical portion; and a second counter-weight portion protruding from the first counter-weight portion toward the orbiting scroll and having a distal end spaced away toward the first counter-weight portion by L/2 or longer in the Z-axis direction from the end of the cylindrical portion near the orbiting scroll.

8. The scroll compressor of claim 1, wherein the main weight portion has a hollow portion provided below the center of the rocking bearing in the Z-axis direction.

9. The scroll compressor of claim 8, wherein the main weight portion has an arc-shaped outer peripheral surface, and wherein the hollow portion is a recess provided in the outer peripheral surface of the main weight portion in a circumferential direction.

* * * * *